US010077518B2

(12) United States Patent
Morimoto et al.

(10) Patent No.: US 10,077,518 B2
(45) Date of Patent: Sep. 18, 2018

(54) CRIMPED CONJUGATED FIBER AND NONWOVEN FABRIC COMPRISING THE SAME

(75) Inventors: Hisashi Morimoto, Ichihara (JP); Kazuhiko Masuda, Chiba (JP)

(73) Assignee: MITSUI CHEMICALS, INC., Minato-Ku, Tokyo (JP)

( * ) Notice: Subject to any disclaimer, the term of this patent is extended or adjusted under 35 U.S.C. 154(b) by 498 days.

(21) Appl. No.: 13/121,978

(22) PCT Filed: Oct. 23, 2009

(86) PCT No.: PCT/JP2009/068241
§ 371 (c)(1),
(2), (4) Date: Mar. 31, 2011

(87) PCT Pub. No.: WO2010/050407
PCT Pub. Date: May 6, 2010

(65) Prior Publication Data

US 2011/0189915 A1 Aug. 4, 2011

(30) Foreign Application Priority Data

Oct. 29, 2008 (JP) ..... 2008-278507

(51) Int. Cl.
*D01F 8/06* (2006.01)
*D04H 3/14* (2012.01)
(Continued)

(52) U.S. Cl.
CPC ..... *D04H 3/14* (2013.01); *D01D 5/22* (2013.01); *D01F 8/06* (2013.01); *D04H 3/16* (2013.01);
(Continued)

(58) Field of Classification Search
CPC ..... D02G 3/045; D02G 3/36; D04H 3/005; D01F 8/04; D01F 8/06
(Continued)

(56) References Cited

U.S. PATENT DOCUMENTS 3,505,164 A 4/1970 Oppenlander
3,509,013 A 4/1970 Oppenlander
(Continued)

FOREIGN PATENT DOCUMENTS

CN 1246164 A 3/2000
EP 0 395 336 A2 10/1990
(Continued)

OTHER PUBLICATIONS

International Search Report (PCT/ISA/210) dated Dec. 8, 2009, by Japanese Patent Office as the International Searching Authority for International Application No. PCT/JP2009/068241.
(Continued)

*Primary Examiner* — Andrew Piziali
(74) *Attorney, Agent, or Firm* — Buchanan, Ingersoll & Rooney PC

(57) ABSTRACT

A crimped conjugated fiber having a cross-sectional configuration wherein: a cross section of the fiber comprises at least a portion (a) comprising a propylene polymer (A) and a portion (b) comprising a propylene polymer (B), the mass ratio of the portion (a) and the portion (b) is in the range of 10:90 to 55:45, the propylene polymer (A) has Mz/Mw (A) and the propylene polymer (B) has Mz/Mw (B) wherein the difference thereof is in the range of 0.30 to 2.2, the absolute value difference of the melting points of the propylene polymer (A) and the propylene polymer (B) is in the range of 0 to 10° C., and the ratio of MFR (A) of the propylene polymer (A) to MFR (B) of the propylene polymer (B) is in
(Continued)

the range of 0.8 to 1.2. A nonwoven fabric of crimped conjugated fiber is also provided.

16 Claims, 4 Drawing Sheets

(51) Int. Cl.
*D01D 5/22* (2006.01)
*D04H 3/16* (2006.01)

(52) U.S. Cl.
CPC ..... *Y10T 428/2924* (2015.01); *Y10T 442/629* (2015.04)

(58) Field of Classification Search
USPC ..... 442/361, 364, 409, 414, 415; 428/364, 428/365, 369, 370, 371, 373, 374
See application file for complete search history.

(56) References Cited

U.S. PATENT DOCUMENTS

| | | | | |
|---|---|---|---|---|
| 3,900,678 | A * | 8/1975 | Aishima et al. | 428/374 |
| 4,705,640 | A * | 11/1987 | Whittaker | B01D 37/03 210/732 |
| 5,108,820 | A * | 4/1992 | Kaneko et al. | 428/198 |
| 5,368,919 | A | 11/1994 | Robeson | |
| 5,462,807 | A * | 10/1995 | Halle et al. | 428/500 |
| 5,556,589 | A * | 9/1996 | Sibal | 264/172.12 |
| 6,074,590 | A | 6/2000 | Gownder | |
| 6,143,854 | A * | 11/2000 | Bamberger et al. | 526/348.1 |
| 6,156,679 | A | 12/2000 | Takaoka et al. | |
| 6,306,973 | B1 * | 10/2001 | Takaoka et al. | 525/240 |
| 6,395,392 | B1 | 5/2002 | Gownder | |
| 6,451,915 | B1 * | 9/2002 | Ellul et al. | 525/191 |
| 6,454,989 | B1 | 9/2002 | Neely et al. | |
| 8,314,199 | B2 * | 11/2012 | Michel | C08F 10/00 502/103 |
| 2004/0067709 | A1 | 4/2004 | Kishine et al. | |
| 2007/0021022 | A1 | 1/2007 | Kishine et al. | |
| 2008/0071032 | A1 * | 3/2008 | Massari et al. | 525/240 |

FOREIGN PATENT DOCUMENTS

| | | | |
|---|---|---|---|
| EP | 0 625 545 | A1 | 11/1994 |
| EP | 0 894 875 | A2 | 2/1999 |
| EP | 0959165 | A | 11/1999 |
| EP | 1 369 518 | A1 | 12/2003 |
| JP | 2-191720 | A | 7/1990 |
| JP | 7-197367 | | 8/1995 |
| JP | 2002-61192 | A | 2/2002 |
| JP | 2002-180331 | A | 6/2002 |
| JP | 2007-308868 | A | 11/2007 |
| WO | WO 98/29586 | A1 | 7/1998 |
| WO | WO 02/061192 | A1 | 8/2002 |

OTHER PUBLICATIONS

Extended European Search Report dated Apr. 15, 2013, in corresponding European Application No. EP 09 82 3518.
Office Action issued in corresponding Chinese Patent Application No. 200980142475.1 dated Dec. 5, 2012.
Notice of Opposition filed in the European Patent Office on Sep. 25, 2014 in corresponding European Patent Application No. 09823518.7.
Charles E. Carraher, Jr., Seymour/Carraher's Polymer Chemistry, Sixth Edition, 2003, Marcel Dekker, Inc., pp. 1-9.
Appeal Notice issued by Boards of Appeal in the European Patent Office on Nov. 28, 2016, in corresponding EP 2343406 B1 (1 page).
Exhibit D10, Spruiell, et al., "The Influence of Isotacticity, Ethylene Comonomer Content, and Nucleating Agent Addition on the Structure and Properties of Melt-Spun Isotactic Polypropylene Filaments", Journal of Applied Polyer Science, 1996, vol. 62, pp. 1965-1975.

* cited by examiner

[Fig. 1]
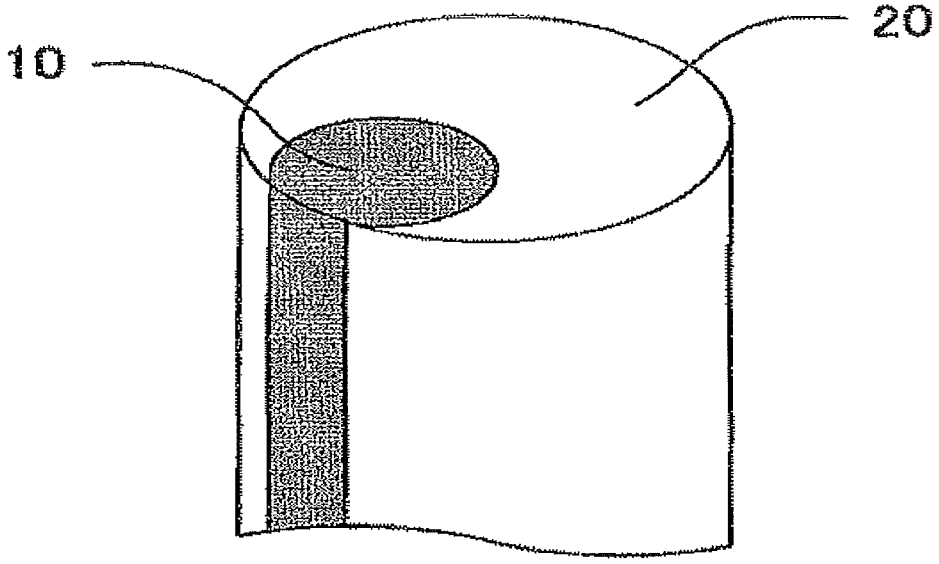
[Fig. 2]
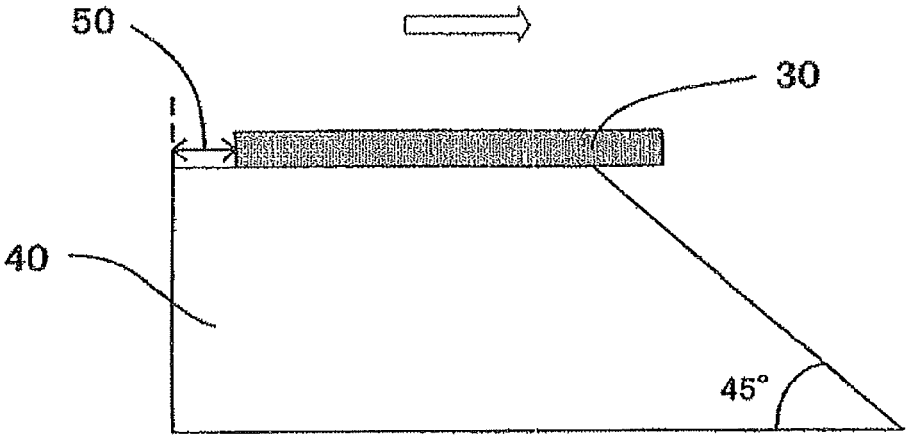

[Fig. 3]
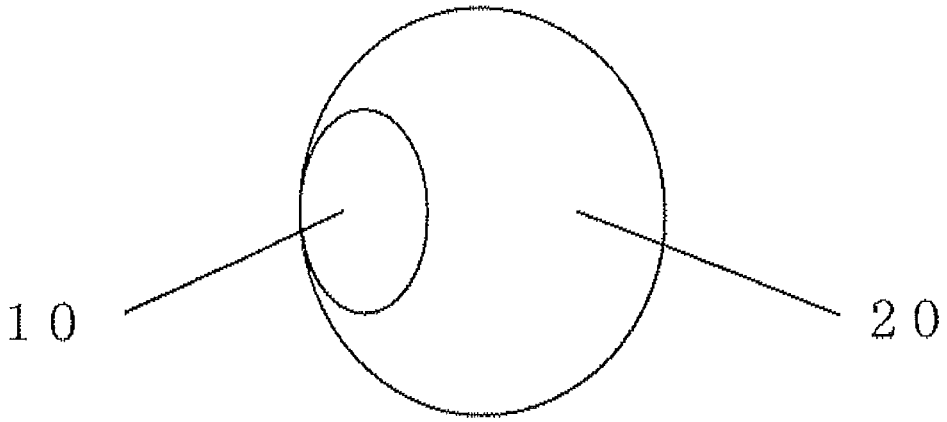
[Fig. 4]
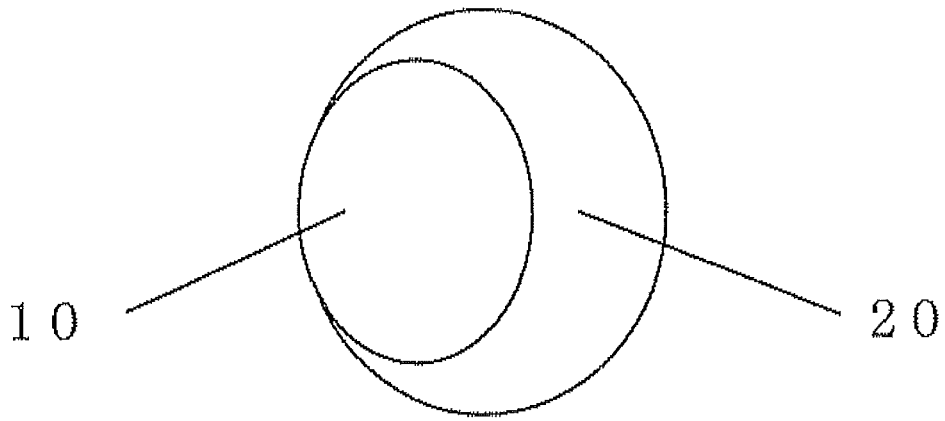

[Fig. 5]
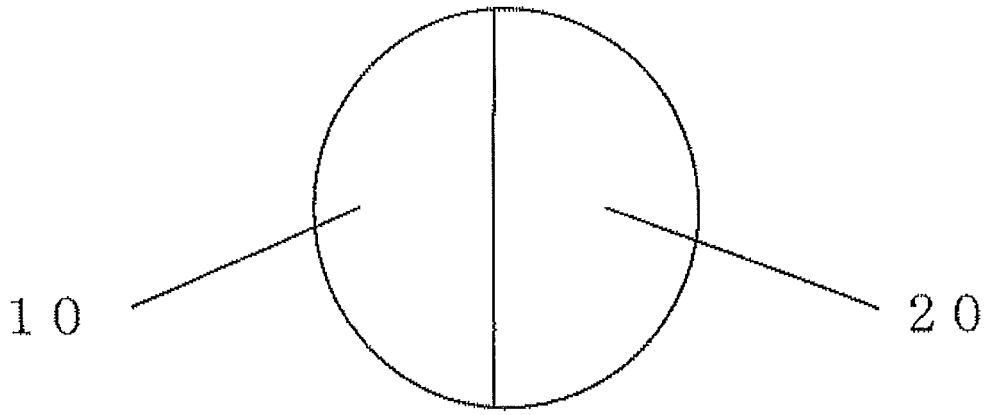
[Fig. 6]
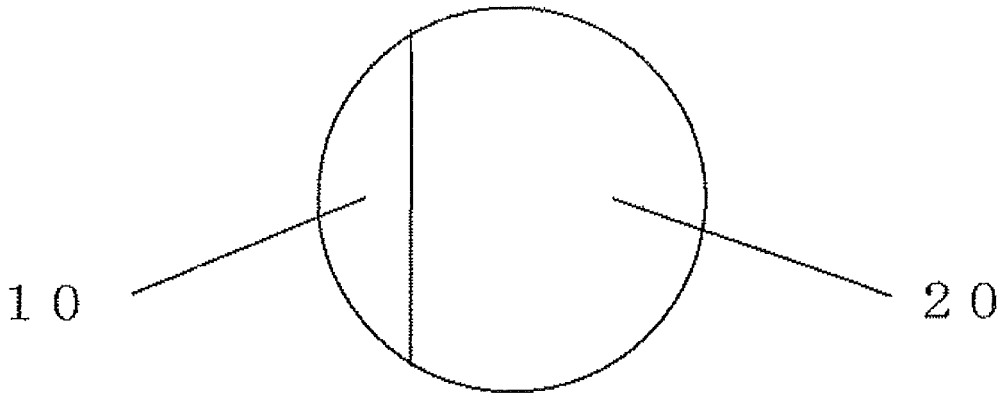

[Fig. 7]
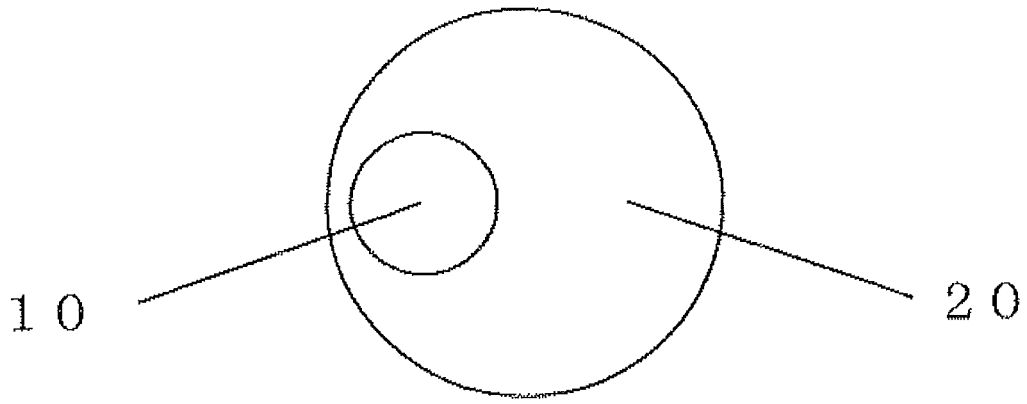
[Fig. 8]
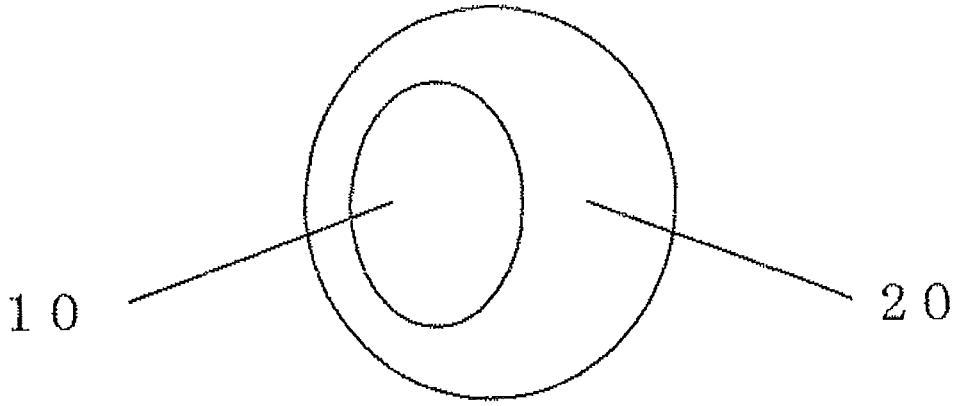

CRIMPED CONJUGATED FIBER AND NONWOVEN FABRIC COMPRISING THE SAME

TECHNICAL FIELD

The present invention relates to crimped conjugated fibers and nonwoven fabrics comprising the fibers.

BACKGROUND ART

Polypropylene nonwoven fabrics have excellent properties such as breathability and softness and are used as hygiene materials including diapers and sanitary items. However, further improvements in their properties have been required. For example, polypropylene nonwoven fabrics improved in softness, bulkiness and mechanical strength are desired.

To obtain nonwoven fabrics having excellent softness and bulkiness, various methods have been proposed in which nonwoven fabrics are formed of crimped polypropylene fibers. For example, Patent Document 1 discloses nonwoven fabrics that comprise conjugated fibers having a crimpable cross-sectional configuration wherein the conjugated fibers comprise a first component comprising propylene polymer and a second component comprising polypropylene with different properties from the first component. The second polypropylene is selected from the group consisting of high MFR polypropylenes, low polydispersity polypropylenes, amorphous polypropylenes and elastic (elastomeric) polypropylenes. According to the disclosure, melt spinning the first component and the second component having different properties from each other and attenuating the resultant conjugated fibers give crimped fibers capable of forming nonwoven fabrics with excellent softness and elastic properties.

Patent Document 2 discloses nonwoven fabrics that comprise parallel type crimped conjugated fibers comprising ethylene/propylene random copolymer and polypropylene.

In Patent Document 1, crimped conjugated fibers are obtained from a combination of polypropylenes having dissimilar properties. In detail, Example 1 discloses a combination of polypropylenes having differing MFR and molecular weight distribution in which parallel type conjugated fibers are formed from a first polypropylene having an MFR of 35 and a polydispersity number of 3 and a second polypropylene having an MFR of 25 and a polydispersity number of 2.

The present inventors preliminarily produced conjugated fibers according to the disclosure of the patent document. It has been then found that spinnability and crimp properties are insufficient.

With regard to the parallel type crimped conjugated fibers of Patent Document 2, crimps are produced utilizing differing crystallization degrees of the ethylene/propylene random copolymer and the polypropylene that are spun. However, nonwoven fabrics obtained from two polymers with differing crystallization degrees have a performance that is an average of the two polymers.

In the background art as described above, the production of crimped polypropylene fibers entails a combination of two propylene polymers having greatly different physical properties, specifically MFR. In the case of identical MFR, a combination should consist of a propylene homopolymer and a propylene/α-olefin random copolymer having different melting points (crystallization temperatures). It has been considered difficult to obtain crimped conjugated fibers from a combination of similar polymers, in particular propylene homopolymers or propylene/α-olefin random copolymers having similar MFR (i.e., melt flow properties).

Further, the use of two propylene polymers greatly differing in melting point restricts production conditions such as melting temperature. In the case of propylene polymers having greatly different MFR, the molten fibers of the propylene polymers can be curved immediately after spun from the nozzle and can adhere and contaminate the nozzle face.

PATENT DOCUMENTS

Patent Document 1: U.S. Pat. No. 6,454,989
Patent Document 2: JP-A-H07-197367

DISCLOSURE OF THE INVENTION

Problems to be Solved by the Invention

It is an object of the present invention to provide crimped conjugated fibers having excellent crimp properties from two kinds of propylene polymers having relatively similar melting points and MFR. The use of such similar polymers has been considered unsuitable for producing crimped fibers.

It is another object of the invention that crimped conjugated fibers are obtained with excellent crimp properties and spinnability from two kinds of propylene homopolymers or propylene/α-olefin random copolymers having similar MFR (i.e., melt flow properties).

Means for Solving the Problems

The present inventors studied diligently and have found that highly crimped conjugated fibers, for example conjugated fibers having an eccentric core-sheath configuration, are obtained from two kinds of propylene polymers by constituting the core from a propylene polymer having a larger Mz/Mw than the propylene polymer used in the sheath. This constitution allows for highly crimped fibers even when the propylene polymers forming the core and sheath have similar MFR and melting points. The present invention has been completed based on the finding.

An aspect of the present invention is a crimped conjugated fiber having a crimpable cross-sectional configuration wherein the cross section of the fiber comprises at least a portion (a) and a portion (b), the mass ratio of the portion (a) and the portion (b) [(a):(b)] is in the range of 10:90 to 55:45, the portion (a) comprises a propylene polymer (A) and the portion (b) comprises a propylene polymer (B), the propylene polymer (A) has Mz/Mw (A) and the propylene polymer (B) has Mz/Mw (B) wherein the difference thereof [Mz/Mw (A)−Mz/Mw (B): ΔMz/Mw] is in the range of 0.30 to 2.2, the propylene polymer (A) has a melting point [Tm (A)] and the propylene polymer (B) has a melting point [Tm (B)] wherein the absolute value of the difference of the melting points is in the range of 0 to 10° C., and the ratio of MFR (A) of the propylene polymer (A) to MFR (B) of the propylene polymer (B) is in the range of 0.8 to 1.2.

Effect of the Invention

The two kinds of propylene polymers used in the present invention have identical or similar MFR and identical or similar melting points to show excellent spinnability, and conjugated fibers produced therefrom have excellent crimp properties. When two kinds of propylene homopolymers are used, nonwoven fabrics having higher strength may be obtained. When two kinds of propylene/α-olefin random copolymers are used, nonwoven fabrics having higher softness may be produced. The present invention thus provides nonwoven fabrics meeting the market needs in strength and softness.

BRIEF DESCRIPTION OF THE DRAWINGS

FIG. 1 is a perspective view showing an embodiment of a crimped conjugated fiber according to the present invention.

FIG. 2 is a view for explaining a softness test for nonwoven fabrics.

FIG. 3 is a cross-sectional view of a crimped conjugated fiber according to the present invention.

FIG. 4 is a cross-sectional view of a crimped conjugated fiber according to the present invention.

FIG. 5 is a cross-sectional view of a crimped conjugated fiber according to the present invention.

FIG. 6 is a cross-sectional view of a crimped conjugated fiber according to the present invention.

FIG. 7 is a cross-sectional view of a crimped conjugated fiber according to the present invention.

FIG. 8 is a cross-sectional view of a crimped conjugated fiber according to the present invention.

EXPLANATION OF NUMERALS

10 . . . portion (a)
20 . . . portion (b)
30 . . . test piece
40 . . . test table
50 . . . distance

BEST MODE FOR CARRYING OUT THE INVENTION

⟨Propylene Polymers⟩

Propylene polymers constitute the crimped conjugated fibers having a crimpable cross-sectional configuration wherein the cross section of the fiber has at least a portion (a) and a portion (b) (hereinafter, also the "crimped conjugated fibers"). The propylene polymers are crystalline propylene polymers based on propylene, with examples including propylene homopolymers and propylene/α-olefin random copolymers of propylene and one or more α-olefins such as ethylene, 1-butene, 1-pentene, 1-hexene, 1-octene, 1-decene, 3-methyl-1-butene, 3-methyl-1-pentene, 3-ethyl-1-pentene, 4-methyl-1-pentene and 4-methyl-1-hexene, for example propylene/ethylene random copolymers and propylene/ethylene/1-butene random copolymers.

A propylene polymer (A) and a propylene polymer (B) for forming the crimped conjugated fibers of the present invention are selected from the above propylene polymers. The propylene polymer (A) forms the portion (a), and the propylene polymer (B) forms the portion (b). The difference between Mz/Mw (A) of the propylene polymer (A) and Mz/Mw (B) of the propylene polymer (B) [Mz/Mw (A)–Mz/Mw (B): ΔMz/Mw], the absolute value of the difference of the melting point [Tm (A)] of the propylene polymer (A) and the melting point [Tm (B)] of the propylene polymer (B), and the ratio of the MFR (A) of the propylene polymer (A) to the MFR (B) of the propylene polymer (B) are each in the range as described hereinabove.

The propylene polymer (A) and the propylene polymer (B) of the present invention may be each a mixture (a composition) of two or more kinds of the above propylene polymers as long as the above properties are satisfied. When a mixture of two or more kinds of the propylene polymers is used as the propylene polymer (A) and/or the propylene polymer (B), the mixture should satisfy the above requirements.

When propylene homopolymers are selected as the propylene polymers (A) and (B) forming the portions (a) and (b), respectively, the obtainable crimped conjugated fibers can give nonwoven fabrics having higher heat resistance and rigidity. When propylene/α-olefin random copolymers are selected as the propylene polymers (A) and (B), the obtainable crimped conjugated fibers can give nonwoven fabrics having higher softness.

The propylene/α-olefin random copolymers in the present invention generally have a melting point (Tm) in the range of 120 to 155° C., and preferably 125 to 150° C. Poor heat resistance may be caused if copolymers having a melting point of less than 120° C. are used.

The propylene polymers (A) and (B) forming the portions (a) and (b) of the crimped conjugated fibers of the present invention may be selected from known propylene polymers as described above while satisfying the above requirements.

For example, the propylene polymers (A) and (B) for forming the portions (a) and (b) of the crimped conjugated continuous fibers of the present invention may be obtained by homopolymerizing propylene or copolymerizing propylene and a small amount of α-olefin by slurry polymerization, gas-phase polymerization or bulk polymerization using a Ziegler-Natta catalyst that contains a titanium-containing solid transition metal component and an organometallic component or a metallocene catalyst that contains a Group IV to VI transition metal compound with at least one cyclopentadienyl skeleton and a cocatalyst component.

The propylene polymers of the present invention may be blended with known additives or other polymers as required while still achieving the objects of the present invention. Exemplary additives are antioxidants, weathering stabilizers, light stabilizers, antistatic agents, anti-fogging agents, anti-blocking agents, lubricants, nucleating agents and pigments.

⟨Propylene Polymers (A)⟩

The propylene polymers (A) for forming the portion (a) of the crimped conjugated fibers of the present invention generally have a melt flow rate (MFR) (ASTM D-1238, 230° C., 2160 g load) of 20 to 100 g/10 min, and preferably 30 to 80 g/10 min. If MFR of the propylene polymers is less than 20 g/10 min, the melt viscosity is high and the spinnability is poor. If MFR of the propylene polymers exceeds 100 g/10 min, the obtainable nonwoven fabrics may have poor tensile strength.

The propylene polymers (A) of the present invention preferably have a ratio of Z-average molecular weight (Mz) to weight average molecular weight (Mw) (Mz/Mw (A)) of 2.40 or above, and more preferably in the range of 2.50 to 4.50. If the Mz/Mw ratio of the propylene polymers (A) exceeds 4.50, the MFR ratio [MFR/MFR] of the propylene polymer (A) to the propylene polymer (B) forming the portion (b) will be less than 0.8 and the spinnability may be deteriorated.

When the propylene polymer (A) has the above Mz/Mw ratio, it is easy to make a combination of the propylene polymer (A) and the propylene polymer (B) such that the difference between the Z-average molecular weight (Mz) to weight average molecular weight (Mw) ratio [Mz/Mw (A)] of the propylene polymer (A), and the Z-average molecular weight (Mz) to weight average molecular weight (Mw) ratio [Mz/Mw (B)] of the propylene polymer (B), i.e., [Mz/Mw (A)−Mz/Mw (B)=ΔMz/Mw], is in the range of 0.30 to 2.2.

The propylene polymers (A) of the present invention generally have Mw in the range of 150,000 to 250,000, and Mz in the range of 300,000 to 600,000.

The propylene polymers (A) of the present invention generally have a ratio of the weight average molecular weight (Mw) to the number average molecular weight (Mn), i.e., molecular weight distribution [Mw/Mn (A)], in the range of 2.0 to 4.0, and preferably 2.2 to 3.5.

In the present invention, Mz, Mw, Mn, Mz/Mw (A) and Mw/Mn (A) of the propylene polymers (A) may be determined by GPC (gel permeation chromatography) as will be described later.

In the production of the propylene polymers (A) described above, propylene polymers differing in MFR, in particular a propylene polymer having an MFR and a small amount of a propylene polymer having an MFR lower than the other propylene polymer may be mixed together or produced by multistage polymerization so that Mz, Mw and Mz/Mw will be in the above-described ranges; alternatively, a propylene polymer having the above Mz, Mw and Mz/Mw may be produced directly.

The Mw/Mn and Mz/Mw of the propylene polymers (A) may be controlled by using specific catalysts and adjusting the polymerization conditions, or by decomposing the polymer with peroxides or the like, or by mixing two or more kinds of polymers differing in molecular weight.

As the propylene polymers (A) of the present invention, commercially available propylene polymers may be used, with examples including NOVATEC PP SA06A manufactured and sold by Japan Polypropylene Corporation.

⟨Propylene Polymers (B)⟩

The propylene polymers (B) for forming the portion (b) of the crimped conjugated fibers of the present invention generally have a melt flow rate (MFR) (ASTM D-1238, 230° C., 2160 g load) of 20 to 100 g/10 min, and preferably 30 to 80 g/10 min. If MFR of the propylene polymers is less than 20 g/10 min, the melt viscosity is high and the spinnability is poor. If MFR of the propylene polymers exceeds 100 g/10 min, the obtainable nonwoven fabrics may have poor tensile strength.

The propylene polymers (B) of the present invention preferably have a ratio of Z-average molecular weight (Mz) to weight average molecular weight (Mw) [Mz/Mw (B)] of not more than 2.50, and more preferably not more than 2.30.

The propylene polymers (B) of the present invention generally have Mw in the range of 150,000 to 250,000, and Mz in the range of 300,000 to 600,000.

The propylene polymers (B) of the present invention generally have a ratio of the weight average molecular weight (Mw) to the number average molecular weight (Mn), i.e., molecular weight distribution [Mw/Mn (B)], in the range of 2.0 to 4.0, and preferably 2.2 to 3.5.

In the present invention, Mz, Mw, Mn, Mz/Mw (B) and Mw/Mn (B) of the propylene polymers (B) may be determined by GPC (gel permeation chromatography) as will be described later.

In the production of the propylene polymers (B) described above, propylene polymers differing in MFR, in particular a propylene polymer having an MFR and a small amount of a propylene polymer having an MFR lower than the other propylene polymer may be mixed together or produced by multistage polymerization so that Mz, Mw and Mz/Mw will be in the above-described ranges; alternatively, a propylene polymer having the above Mz, Mw and Mz/Mw may be produced directly.

The Mw/Mn and Mz/Mw of the propylene polymers (B) may be controlled by using specific catalysts and adjusting the polymerization conditions, or by decomposing the polymer with peroxides or the like, or by mixing two or more kinds of polymers differing in molecular weight.

As the propylene polymers (B) of the present invention, commercially available propylene polymers may be used, with examples including Prime Polypro 5119 manufactured and sold by Prime Polymer Co., Ltd.

<Crimped Conjugated Fibers>

The crimped conjugated fiber of the present invention includes the propylene polymer (A) and the propylene polymer (B) and has a crimpable cross-sectional configuration wherein the cross section of the fiber has at least a portion (a) and a portion (b).

The mass ratio of the portion (a) and the portion (b) [(a):(b)] is in the range of 10:90 to 55:45.

The portion (a) comprises the propylene polymer (A) and the portion (b) comprises the propylene polymer (B).

The difference between Mz/Mw (A) of the propylene polymer (A) and Mz/Mw (B) of the propylene polymer (B), [Mz/Mw (A)−Mz/Mw (B): ΔMz/Mw], is in the range of 0.30 to 2.2.

The absolute value of the difference between the melting point [Tm (A)] of the propylene polymer (A) and the melting point [Tm (B)] of the propylene polymer (B) is in the range of 0 to 10° C.

The ratio of the MFR (A) of the propylene polymer (A) to the MFR (B) of the propylene polymer (B) is in the range of 0.8 to 1.2.

In an embodiment, the crimpable cross-sectional configuration may be an eccentric core-sheath configuration in which the core is the portion (a) formed of the propylene polymer (A) with larger Mz/Mw, and the sheath is the portion (b) formed of the propylene polymer (B) with smaller Mz/Mw. The core (the portion (a)) may be completely covered with the sheath of the propylene polymer (B) with smaller Mz/Mw, or part of the core may be exposed on the surface of the crimped conjugated fiber. The joint between the core and the sheath may be straight or curved. In an embodiment, the joint between the core and the sheath may be straight and part of the core may be exposed on the surface of the crimped conjugated fiber, a configuration is known as the side-by-side configuration.

<Mass Ratio of the Portion (a) and the Portion (b)>

In the crimped conjugated fibers of the present invention, the mass ratio of the portion (a) and the portion (b) [(a):(b)] is in the range of 10:90 to 55:45, preferably 10:90 to 50:50, and more preferably 20:80 to 40:60. If the mass ratio [(a):(b)] is in excess of or below this range, crimp properties are deteriorated.

⟨ΔMz/Mw⟩

The difference between Mz/Mw (A) of the propylene polymer (A) for the portion (a) and Mz/Mw (B) of the propylene polymer (B) for the portion (b), [Mz/Mw (A)−Mz/Mw (B): ΔMz/Mw], is in the range of 0.30 to 2.2, preferably 0.35 to 2.0, and more preferably 0.40 to 1.0. If propylene polymers having ΔMz/Mw of less than 0.30 are used, crimps may not be developed. If ΔMz/Mw exceeds 2.2, the spinnability may be deteriorated. Herein, Mz is known as the Z-average molecular weight and is defined by Equation (1) below:

$$Mz = \frac{\sum M_i^3 N_i}{\sum M_i^2 N_i} \quad (1)$$

In Equation (1), $M_i$ is the molecular weight of the polymer (the propylene polymer) and $N_i$ is the number of moles of the polymer (the propylene polymer).

In general, Mz is considered to reflect more precisely high-molecular weight components in a polymer. Therefore, the Mz/Mw indicates a molecular weight distribution reflecting more precisely high-molecular weight components than the usual molecular weight distribution Mw/Mn. The molecular weight distribution Mz/Mw affects fiber crimp properties.

⟨ΔMw/Mn⟩

As long as ΔMz/Mw is in the range described above, the absolute value of the difference between Mw/Mn (A) of the propylene polymer (A) and Mw/Mn (B) of the propylene polymer (B) [Mw/Mn (A)−Mw/Mn (B): ΔMw/Mn] may be 1.5 or below, even in the range of 0.3 to 1.0, the obtainable conjugated fibers still develop crimps. The ratio Mw/Mn is generally known as the molecular weight distribution (polydispersity degree) indicating the degree of molecular weight distribution of a polymer. If ΔMw/Mn is excessively large, flow properties and crystallization behaviors greatly differ between one material (the portion (a)) and another material (the portion (b)), possibly resulting in deteriorated fiber spinnability. In the present invention, the numerical ranges indicated with "to" include the numbers at the sides of the "to".

ΔMz/Mw and ΔMw/Mn are obtained by determining Mz/Mw and Mw/Mn of the propylene polymers (A) and (B) for the portions (a) and (b) by GPC analysis and calculating the absolute values of the differences of these ratios.

In the present invention, GPC analysis is performed under the following conditions.

(1) 30 mg of the propylene polymer is completely dissolved in 20 ml of o-dichlorobenzene at 145° C.

(2) The solution is filtered through a sintered filter having a pore size of 1.0 μm to provide a sample.

(3) The sample is analyzed by GPC and the average molecular weights and molecular weight distribution curves are obtained with reference to polystyrene (PS) standards.

The measurement apparatuses and conditions are as follows.

Chromatograph: Gel permeation chromatograph Alliance GPC 2000 (manufactured by Waters)

Analyzer: Data processing software Empower 2 (manufactured by Waters)

Columns: Two TSK gel GMH6-HT columns+two TSK gel GMH6-HTL columns (each 7.5 mm in inner diameter and 30 cm in length, manufactured by TOSOH CORPORATION)

Column temperature: 140° C.

Mobile phase: o-dichlorobenzene (containing 0.025% of butylated hydroxytoluene (BHT))

Detector: Differential refractometer

Flow rate: 1 ml/min

Sample concentration: 30 mg/20 ml

Injection amount: 500 μl

Sampling time intervals: 1 sec

Column calibration: Monodisperse polystyrenes (manufactured by TOSOH CORPORATION)

Molecular weight conversion: PS conversion/standard conversion methods

⟨|ΔTm|⟩

In order to obtain crimped fibers, it is generally known that the difference in melting point between a propylene polymer forming a portion (a) and a propylene polymer forming a portion (b) should be at least 10° C., and that the larger the difference in melting point is, the more excellent the crimp properties of the obtainable fibers are. In the present invention, however, the absolute value of the difference between the melting point of the propylene polymer (A) forming the portion (a) and the melting point of the propylene polymer (B) forming the portion (b) (hereinafter, also |ΔTm|) is in the range of 0 to 10° C., for example 0 to 5° C. Even with such similar melting points, the obtainable fibers show excellent crimp properties.

In general, propylene polymers of low melting point, i.e., propylene/α-olefin random copolymers have high softness, and propylene polymers of high melting point, i.e., propylene homopolymers have high rigidity. Accordingly, crimped conjugated fibers comprising a propylene/α-olefin random copolymer and a propylene homopolymer show average properties of the two polymers and cannot give nonwoven fabrics having excellent softness or rigidity.

The value of |ΔTm| may be obtained by determining the melting points of the propylene polymers (A) and (B) for the portions (a) and (b) and calculating the absolute value of the difference thereof.

In the present invention, the melting point may be measured as follows.

(1) The propylene polymer is set in a pan of a differential scanning calorimeter (DSC) manufactured by PerkinElmer Co., Ltd. The pan is heated from 30° C. to 200° C. at a rate of 10° C./min, held at 200° C. for 10 minutes, and cooled to 30° C. at a rate of 10° C./min.

(2) The pan is heated again from 30° C. to 200° C. at a rate of 10° C./min, and the melting point is obtained from the peak recorded during this second heating process.

<MFR Ratio>

The ratio of the MFR of the propylene polymer (A) for the portion (a) to the MFR of the propylene polymer (B) for the portion (b) (hereinafter, also the MFR ratio) of the present invention is in the range of 0.8 to 1.2. In the conventional art, the MFR ratio of a polymer for a portion (a) to a polymer for a portion (b) is required to be less than 0.8 or more than 1.2 in order to produce crimped fibers. Meanwhile, higher spinnability is obtained as the MFR ratio is smaller between a propylene polymer for a portion (a) and a propylene polymer for a portion (b). According to the present invention, conjugated fibers having excellent crimp properties are obtained even with the above MFR ratio. The MFR of the propylene polymers (A) and (B) in the present invention are preferably in the range of 20 to 100 g/10 min.

In the present invention, MFR is determined at 230° C. under 2160 g load in accordance with ASTM D 1238.

<Crimp Number and Other Properties of Crimped Conjugated Fibers>

The number of crimps of the crimped conjugated fibers according to the present invention may be determined in accordance with JIS L 1015. The number of crimps is usually 5 or more, and preferably 10 to 40, per 25 mm of the fiber. If the number of crimps is less than the lower limit, the crimped fibers may not achieve characteristics such as bulkiness by the three dimensional helical structure. If the number of crimps is larger than the upper limit, uniform distribution of the fibers is difficult and the obtainable nonwoven fabrics may have deteriorated texture or mechanical strength.

The diameter of the crimped conjugated fibers of the present invention is not particularly limited, but is usually in the range of 0.5 to 5 denier, and preferably 0.5 to 3 denier. This fineness ensures excellent spinnability, crimp properties, and mechanical strength of the obtainable nonwoven fabrics.

FIG. 1 is a perspective view showing an embodiment of the crimped conjugated fibers according to the present invention. In the figure, 10 indicates the portion (a) and 20 indicates the portion (b).

The crimped conjugated fibers of the present invention have a crimpable cross-sectional configuration wherein the cross section of the fiber has at least the portion (a) and the portion (b). In the cross section of the crimped conjugated fiber, the proportions of the portion (a) and the portion (b) are such that the mass ratio [(a):(b)] is in the range of 10:90 to 55:45, preferably 10:90 to 50:50, and more preferably 20:80 to 40:60.

The crimped conjugated fibers may have any shapes without limitation as long as they have a crimpable cross-sectional configuration. Exemplary shapes include side-by-side (parallel) crimped conjugated fibers in which the portion (a) and the portion (b) are arranged adjacent to each other, and core-sheath crimped conjugated fibers in which the portion (a) forms a core (a') and the portion (b) forms a sheath (b').

The core-sheath crimped conjugated fibers preferably have the mass ratio of the core (a') and the sheath (b') [(a'):(b')] in the range of 10-30:90-70.

FIGS. 3 to 8 show other cross-sectional views of crimped conjugated fibers according to the present invention. In the figures, 10 indicates the portion (a) and 20 indicates the portion (b).

The term "core-sheath crimped conjugated fibers" refers to fibers which have a core and a sheath and are crimped. The core (a') is arranged with at least part thereof being surrounded by a polymer different from the core (a') in the fiber cross section and extends along the length of the fiber. The sheath (b') is arranged so as to surround at least part of the core (a') in the fiber cross section and extends along the length of the fiber. In an eccentric core-sheath crimped conjugated fiber, the core (a') and the sheath (b') are located non-concentrically in the cross section of the fiber. The eccentric core-sheath crimped conjugated fibers include an exposed type in which the side of the core (a') is exposed, and a non-exposed type in which the core (a') is fully occluded. In the present invention, eccentric core-sheath crimped conjugated fibers of the exposed type are preferred because they show excellent crimp properties. The cross sectional joint between the core (a') and the sheath (b') may be straight or curved. The core may be circular, elliptical or square in cross section.

The crimped conjugated fibers of the present invention may be staple fibers or continuous fibers. Continuous fibers are preferable because the obtainable nonwoven fabrics do not have loss of the crimped conjugated fibers and excellent fuzzing resistance is achieved.

⟨Nonwoven Fabrics⟩

The nonwoven fabrics of the present invention are made of the above crimped conjugated fibers. The nonwoven fabrics usually have a basis weight (mass per unit area of the nonwoven fabric) of 3 to 100 g/m$^2$, and preferably 7 to 60 g/m$^2$.

The nonwoven fabrics of the present invention preferably comprise the crimped conjugated fibers that are continuous fibers. In view of productivity, the nonwoven fabrics are particularly preferably spunbonded nonwoven fabrics of such fibers.

In the nonwoven fabrics of the present invention, it is preferable that the crimped conjugated fibers are fusion bonded by embossing, whereby the fibers maintain stability and strength.

⟨Nonwoven Fabric Laminate⟩

The nonwoven fabrics comprising the crimped conjugated fibers of the present invention (hereinafter, also referred to as the crimped conjugated fiber nonwoven fabrics to be distinguished from usual nonwoven fabrics) may be laminated with various layers depending on use.

In detail, they may be laminated with knitted fabrics, woven fabrics, nonwoven fabrics, films and the like. The crimped conjugated fiber nonwoven fabrics may be laminated (joined) with such other layers by known methods including thermal fusion bonding methods such as heat embossing and ultrasonic fusion bonding, mechanical entanglement methods such as needle punching and water jetting, adhesive bonding methods with hot melt adhesives or urethane adhesives, and extrusion laminating methods.

The nonwoven fabrics laminated with the crimped conjugated fiber nonwoven fabrics include various known nonwoven fabrics such as spunbonded nonwoven fabrics, meltblown nonwoven fabrics, wet nonwoven fabrics, dry nonwoven fabrics, dry pulp nonwoven fabrics, flash-spun nonwoven fabrics and spread-fiber nonwoven fabrics.

The materials for such nonwoven fabrics may be conventional thermoplastic resins. Examples thereof include homopolymers and copolymers of α-olefins such as ethylene, propylene, 1-butene, 1-hexene, 4-methyl-1-pentene and 1-octene, namely, polyolefins such as high-pressure low-density polyethylenes, linear low-density polyethylenes (LLDPE), high-density polyethylenes, polypropylenes, polypropylene random copolymers, poly-1-butene, poly-4-methyl-1-pentene, ethylene/propylene random copolymers, ethylene/1-butene random copolymers and propylene/1-butene random copolymers; polyesters such as polyethylene terephthalate, polybutylene terephthalate and polyethylene naphthalate; polyamides such as nylon-6, nylon-66 and polymethaxyleneadipamide; polyvinyl chloride, polyimides, ethylene/vinyl acetate copolymers, polyacrylonitriles, polycarbonates, polystyrenes, ionomers and thermoplastic polyurethanes; and mixtures of these resins. Of these, high-pressure low-density polyethylenes, linear low-density polyethylenes (LLDPE), high-density polyethylenes, polypropylenes, polypropylene random copolymers, polyethylene terephthalate and polyamides are preferred.

In a preferred embodiment of the present invention, the crimped conjugated fiber nonwoven fabric is laminated with a spunbonded nonwoven fabric made of an ultrafine fiber (fineness: 0.8 to 2.5 denier, more preferably 0.8 to 1.5 denier) and/or a meltblown nonwoven fabric. Specific examples include two-layer laminates such as spunbonded nonwoven fabric (ultrafine fiber)/crimped conjugated fiber nonwoven fabric, and meltblown nonwoven fabric/crimped conjugated fiber nonwoven fabric; three-layer laminates such as spunbonded nonwoven fabric (ultrafine fiber)/crimped conjugated fiber nonwoven fabric/spunbonded nonwoven fabric (ultrafine fiber), spunbonded nonwoven fabric (ultrafine fiber)/crimped conjugated fiber nonwoven fabric/meltblown nonwoven fabric, and spunbonded nonwoven fabric (ultrafine fiber)/meltblown nonwoven fabric/crimped conjugated fiber nonwoven fabric; and laminates having four or more layers such as spunbonded nonwoven fabric (ultrafine fiber)/crimped conjugated fiber nonwoven fabric/ meltblown nonwoven fabric/spunbonded nonwoven fabric (ultrafine fiber), and spunbonded nonwoven fabric (ultrafine fiber)/crimped conjugated fiber nonwoven fabric/meltblown nonwoven fabric/crimped conjugated fiber nonwoven fabric/spunbonded nonwoven fabric (ultrafine fiber). The basis weight of each nonwoven fabric layer in the laminate is preferably in the range of 2 to 25 g/m$^2$. The spunbonded nonwoven fabrics of the ultrafine fibers described above may be obtained by controlling (selecting) the spunbonding conditions. The nonwoven fabric laminates benefit from the bulkiness and softness of the crimped conjugated fiber nonwoven fabric of the present invention and also achieve excellent surface smoothness and improved water resistance.

The films laminated with the crimped conjugated fiber nonwoven fabrics of the present invention are preferably breathable (moisture permeable) films in order to take advantage of the breathability of the crimped conjugated fiber nonwoven fabrics. Various known breathable films may be used, with examples including films of moisture permeable thermoplastic elastomers such as polyurethane elastomers, polyester elastomers and polyamide elastomers; and porous films obtained by stretching thermoplastic resin films containing inorganic or organic fine particles to create pores in the films. Preferred thermoplastic resins for the porous films are high-pressure low-density polyethylenes, linear low-density polyethylenes (LLDPE), high-density polyethylenes, polypropylenes, polypropylene random copolymers and compositions containing these polyolefins.

The laminates with the breathable films are cloth-like composite materials having bulkiness and softness of the crimped conjugated fiber nonwoven fabrics of the present invention and very high water resistance.

<Processes for Producing Nonwoven Fabrics>

The nonwoven fabrics of the present invention may be produced by any known processes while still achieving the advantageous effects of the present invention. A preferred production process is described below.

The nonwoven fabrics of the present invention are preferably produced through:

(1) a step in which the propylene polymers (A) and (B) for the portions (a) and (b) are separately molten in respective extruders and are spun from a composite spinning nozzle into conjugated fibers;

(2) a step in which the conjugated fibers are quenched, then drawn and attenuated to develop crimps, and the crimped conjugated fibers are deposited on a collecting belt to a desired thickness; and (3) a step in which the deposited conjugated fibers are entangled.

This process is called a spunbonding process.

Step (1)

In this step, known extruders and composite spinning nozzles may be used. The melting temperature is not particularly limited but is preferably higher by approximately 50° C. than the melting point of the propylene polymers. The spinnability in this step is evaluated based on the presence or absence of fiber breakage within a predetermined time.

Step (2)

In this step, the molten fibers are preferably quenched by blowing air. The air temperature may be 10 to 40° C. The quenched fibers may be controlled to a desired thickness by the tensile force of blowing air. The quenched fibers develop crimps. The collecting belt may be conventional but is preferably one that is capable of conveying the crimped fibers, for example a belt conveyer.

Step (3)

The entanglement treatment in this step may be performed for example by applying water jet or ultrasonic wave to the deposited crimped conjugated fibers (hereinafter, also the fibers) or by thermally fusion bonding the fibers by embossing or hot air.

In the present invention, it is particularly preferable that the crimped conjugated fibers are embossed, whereby nonwoven fabrics having excellent strength are obtained. The embossing is carried out under conditions such that the embossed area percentage will be 5 to 30%. The embossed area percentage represents the total area of emboss relative to the total area of the nonwoven fabric. Reducing the embossed area provides nonwoven fabrics with excellent softness. Increasing the embossed area gives nonwoven fabrics having excellent rigidity and mechanical strength.

The embossing temperature is preferably controlled depending on the melting points of the portions (a) and (b). For the propylene polymers, the embossing temperature is usually in the range of 100 to 150° C.

EXAMPLES

The present invention will be described in greater detail by examples hereinbelow without limiting the scope of the invention.

The propylene polymers used in Examples and Comparative Examples of the present invention are listed below.

(1) Propylene Homopolymers

Prime Polypro 5119 (Nishioki), S119 (NP), F113G, S12A and HS135 manufactured by Prime Polymer Co., Ltd.

NOVATEC PP SA06A manufactured by Japan Polypropylene Corporation.

Achieve 3854 and Exxon Mobil PP3155 manufactured by Exxon Mobil Corporation.

(2) Propylene/Ethylene Random Copolymers

Prime Polypro S229R (manufactured by Prime Polymer Co., Ltd.), low-MFR copolymer (sample)

Example 1

A propylene polymer (A) for forming a core was a composition (blend) of propylene homopolymers 5119 (Nishioki)/F113G=94/6 (mass ratio). A propylene polymer (B) for forming a sheath was 5119 (Nishioki). The polymers were melt-spun by a spunbonding method.

In the spunbonding method, single-screw extruders were used and the propylene polymer (A) and the propylene polymer (B) were molten at 200° C.

The polymers were spun into continuous fibers in which the mass ratio of a core h1 and a sheath h2 was 20:80. The fineness was 2.3 denier.

The resultant eccentric core-sheath crimped conjugated continuous fibers that were melt-spun were deposited on a collecting surface to form a nonwoven fabric. The nonwoven fabric was embossed at 133° C. The embossed area percentage was 18%. The embossed nonwoven fabric had a basis weight of 25 g/m$^2$. The crimped conjugated continuous fibers and the nonwoven fabric were evaluated for properties by the following methods.

(1) Number of Crimps

The number of crimps was measured in accordance with JIS L 1015.

The crimp properties were evaluated AA when the number of crimps was 10 or more per 25 mm, BB when the number of crimps was from 5 to less than 10 per 25 mm, and CC when the number of crimps was from 0 to less than 5 per 25 mm.

(2) Strength at Maximum Elongation

Rectangular test pieces 25 mm in width were prepared which had a longitudinal direction parallel to MD or a longitudinal direction parallel to CD. The test pieces were tensile tested with a chuck distance of 100 mm at a tension rate of 100 mm/min, and the maximum tensile load was obtained as the strength at maximum elongation.

(3) 2% Tensile Elongation Strength

A test piece 600 mm in MD×100 mm in CD was prepared.

The test piece was wound around an iron rod 10 mm in diameter and 700 mm in length and was formed into a tubular sample having a length of 600 mm. The sample was tensile tested with a chuck distance of 500 mm at a tension rate of 500 mm/min, and the load at 1.5% elongation and at 2.5% elongation was measured. The 2% tensile elongation strength was obtained from the following equation:

2% tensile elongation strength (N/cm)=(load at 2.5% elongation−load at 1.5% elongation)/10 cm×100

Nonwoven fabrics having a higher value of 2% tensile elongation strength were evaluated to have higher rigidity, and those with a lower value were evaluated to have higher softness.

(4) Softness

The softness was evaluated by a cantilever method in accordance with JIS L 1096. In detail, the evaluation was made as follows.

A 2×15 cm test piece 30 was prepared and was placed on a test table 40 as illustrated in FIG. 2.

The test piece 30 was slowly pushed in the direction of arrow until it bent, and a distance 50 was measured.

The above testing was carried out along each of MD and CD of the test pieces.

Nonwoven fabrics having a higher value of this testing were evaluated to have higher rigidity, and those with a lower value were evaluated to have higher softness.

(5) Thickness

Five test pieces (100 mm×100 mm) were sampled from a test sample. With respect to each test piece, the thickness was measured at arbitrary three points with a constant pressure thickness gauge (manufactured by OZAKI MFG. CO. LTD.). The gauge head had a diameter of 16 mm, and the load was 3.6 g/cm$^2$. The value was read after 30±5 seconds after the gauge head completely contacted the test piece. The results of the five test pieces were averaged to determine the thickness. Nonwoven fabrics having a higher value of thickness were evaluated to have higher bulkiness.

The measurement results are set forth in Table 1.

Example 2

Crimped conjugated continuous fibers and nonwoven fabrics were obtained in the same manner as in Example 1, except that the propylene polymer (A) was changed to SA06A, the propylene polymer (B) was changed to 5119 (NP), and the mass ratio of a core h3 and a sheath h4 in the continuous fiber was 50:50. The measurement results for the crimped conjugated continuous fibers and nonwoven fabrics are set forth in Table 1.

Example 3

Crimped conjugated continuous fibers and nonwoven fabrics were obtained in the same manner as in Example 2, except that the propylene polymer (A) was changed to a S229R/low-MFR copolymer blend (96/4 by mass) (a propylene/ethylene random copolymer composition), the propylene polymer (B) was changed to S229, and the embossing temperature was changed to 120° C. The measurement results for the crimped conjugated continuous fibers and nonwoven fabrics are set forth in Table 1.

Example 4

Crimped conjugated continuous fibers and nonwoven fabrics were obtained in the same manner as in Example 1, except that the propylene polymers (A) and (B) were as indicated in Table 1, and the mass ratio of a core h3 and a sheath h4 in the continuous fiber was 30:70. The measurement results for the crimped conjugated continuous fibers and nonwoven fabrics are set forth in Table 1.

Example 5

A propylene polymer (A) and a propylene polymer (B) as indicated in Table 1 were melt-spun by a spunbonding method to form crimped conjugated continuous fibers in which the mass ratio of a core h3 and a sheath h4 in the continuous fiber was 10:90.

In the spunbonding method, single-screw extruders were used and the propylene polymer (A) and the propylene polymer (B) were molten at 200° C.

The crimp properties and spinnability for the crimped conjugated continuous fibers are set forth in Table 1.

Example 6

A propylene polymer (A) and a propylene polymer (B) as indicated in Table 1 were melt-spun by a spunbonding method to form crimped conjugated continuous fibers in which the mass ratio of a core h3 and a sheath h4 in the continuous fiber was 20:80.

In the spunbonding method, single-screw extruders were used and the propylene polymer (A) and the propylene polymer (B) were molten at 200° C.

The crimp properties and spinnability for the crimped conjugated continuous fibers are set forth in Table 1.

Example 7

A propylene polymer (A) and a propylene polymer (B) as indicated in Table 1 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 1.

Example 8

A propylene polymer (A) and a propylene polymer (B) as indicated in Table 1 were melt-spun by a spunbonding method to form crimped conjugated continuous fibers in which the mass ratio of a core h3 and a sheath h4 in the continuous fiber was 20:80.

In the spunbonding method, single-screw extruders were used and the propylene polymer (A) and the propylene polymer (B) were molten at 200° C.

The crimp properties and spinnability for the crimped conjugated continuous fibers are set forth in Table 1.

Example 9

A propylene polymer (A) and a propylene polymer (B) as indicated in Table 1 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 1.

TABLE 1

| | | | Ex. 1 | Ex. 2 | Ex. 3 | Ex. 4 |
|---|---|---|---|---|---|---|
| Core | Polymer | | S119 Nishioki/ F113 = 94/6 | SA06A | S229/low MFR = 96/4 | SA06A |
| | MFR | g/10 min | 52 | 59 | 56 | 59 |
| | Mw | — | 232,000 | 207,000 | 211,000 | 207,000 |
| | Mn | — | 65,900 | 68,700 | 76,500 | 68,700 |
| | Mw/Mn | — | 3.52 | 3.01 | 2.76 | 3.01 |
| | Mz | — | 775,500 | 524,000 | 536,600 | 524,000 |
| | Mz/Mw | — | 3.34 | 2.53 | 2.54 | 2.53 |
| | Tm | ° C. | 158 | 161 | 143 | 161 |
| Sheath | Polymer | | S119 Nishioki | S119NP | S229R | S119NP |
| | MFR | g/10 min | 63 | 63 | 63 | 63 |
| | Mw | — | 204,000 | 189,000 | 204,000 | 189,000 |
| | Mn | — | 62,200 | 74,800 | 74,600 | 74,800 |
| | Mw/Mn | — | 3.28 | 2.53 | 2.73 | 2.53 |
| | Mz | — | 457,000 | 393,000 | 446,000 | 393,000 |
| | Mz/Mw | — | 2.24 | 2.08 | 2.19 | 2.08 |
| | Tm | ° C. | 158 | 158 | 143 | 158 |
| | Core:sheath ratio | | 20:80 | 50:50 | 50:50 | 30:70 |
| | \|ΔMz/Mw\| | — | 1.1 | 0.45 | 0.36 | 0.45 |
| | \|ΔMw/Mn\| | — | 0.24 | 0.49 | 0.02 | 0.49 |
| | MFR ratio | — | 0.83 | 0.94 | 0.89 | 0.94 |
| | \|ΔTm\| | ° C. | 0 | 3 | 0 | 3 |
| | Melting temperature | ° C. | 200 | 200 | 200 | 200 |
| Embossing conditions | Embossed area percentage | % | 18 | 18 | 18 | 18 |
| | Linear pressure | N/mm | 60 | 60 | 60 | 60 |
| | Emboss roll temperature | ° C. | 133 | 133 | 120 | 133 |
| | Crown roll temperature | ° C. | 133 | 133 | 120 | 133 |
| Properties | Basis weight | $g/m^2$ | 24.2 | 24.8 | 24.8 | 25.0 |
| | Thickness | μm | 320 | 322 | 272 | 323 |
| | Porosity | % | 91.7 | 91.5 | 90.0 | 91.5 |
| | 2% tensile elongation strength (MD) | N/cm | 104 | 103 | 62 | 103 |
| | Softness in MD (distance) | mm | 54 | 53 | 47 | 53 |
| Crimp properties | | | AA | AA | AA | AA |
| Number of crimps | | crimps/25 mm | 13.9 | 15.0 | 16.5 | 11.2 |
| Spinnability | | | Sufficient | Sufficient | Sufficient | Sufficient |

| | | | Ex. 5 | Ex. 6 | Ex. 7 | Ex. 8 | Ex. 9 |
|---|---|---|---|---|---|---|---|
| Core | Polymer | | SA06A | S119 Nishioki/ Y200GP = 80/20 | S119 Nishioki/ Y200GP = 80/20 | SA06A | SA06A |
| | MFR | g/10 min | 59 | 34 | 34 | 59 | 59 |
| | Mw | — | 207,000 | 231,000 | 231,000 | 207,000 | 207,000 |
| | Mn | — | 68,700 | 62,600 | 62,600 | 68,700 | 68,700 |
| | Mw/Mn | — | 3.01 | 3.69 | 3.69 | 3.01 | 3.01 |
| | Mz | — | 524,000 | 787,000 | 787,000 | 524,000 | 524,000 |
| | Mz/Mw | — | 2.53 | 3.41 | 3.41 | 2.53 | 2.53 |
| | Tm | ° C. | 161 | 161 | 161 | 161 | 161 |
| Sheath | Polymer | | S119NP | Exxon 3155 | Exxon 3155 | S119 Nishioki | S119 Nishioki |
| | MFR | g/10 min | 63 | 35 | 35 | 63 | 63 |
| | Mw | — | 189,000 | 232,000 | 232,000 | 204,000 | 204,000 |
| | Mn | — | 74,800 | 49,500 | 49,500 | 62,200 | 62,200 |
| | Mw/Mn | — | 2.53 | 4.69 | 4.69 | 3.28 | 3.28 |
| | Mz | — | 393,000 | 573,000 | 573,000 | 457,000 | 457,000 |
| | Mz/Mw | — | 2.08 | 2.47 | 2.47 | 2.24 | 2.24 |
| | Tm | ° C. | 158 | 160 | 160 | 158 | 158 |
| | Core:sheath ratio | | 10:90 | 20:80 | 50:50 | 20:80 | 50:50 |
| | \|ΔMz/Mw\| | — | 0.45 | 0.94 | 0.94 | 0.3 | 0.3 |
| | \|ΔMw/Mn\| | — | 0.49 | 1.00 | 1.00 | 0.27 | 0.27 |
| | MFR ratio | — | 0.94 | 0.97 | 0.97 | 0.94 | 0.94 |
| | \|ΔTm\| | ° C. | 3 | 1 | 1 | 3 | 3 |
| | Melting temperature | ° C. | 200 | 200 | 200 | 200 | 200 |

TABLE 1-continued

| | | | | | | | |
|---|---|---|---|---|---|---|---|
| Embossing conditions | Embossed area percentage | % | — | — | — | — | — |
| | Linear pressure | N/mm | — | — | — | — | — |
| | Emboss roll temperature | ° C. | — | — | — | — | — |
| | Crown roll temperature | ° C. | — | — | — | — | — |
| Properties | Basis weight | $g/m^2$ | — | — | — | — | — |
| | Thickness | μm | — | — | — | — | — |
| | Porosity | % | — | — | — | — | — |
| | 2% tensile elongation strength (MD) | N/cm | — | — | — | — | — |
| | Softness in MD (distance) | mm | — | — | — | — | — |
| Crimp properties | | | BB | AA | AA | AA | AA |
| Number of crimps | | crimps/25 mm | 6.1 | 24.5 | 13.9 | 14.4 | 14.3 |
| Spinnability | | | Sufficient | Sufficient | Sufficient | Sufficient | Sufficient |

Comparative Example 1

Conjugated continuous fibers and nonwoven fabrics were obtained in the same manner as in Example 1, except that the propylene polymers (A) and (B) used for the core and the sheath were both changed to 5119 (Nishioki). The conjugated continuous fibers did not develop crimps. The measurement results for the conjugated continuous fibers and nonwoven fabrics are set forth in Table 2.

Comparative Example 2

Conjugated continuous fibers and nonwoven fabrics were obtained in the same manner as in Example 3, except that the propylene polymers (A) and (B) used for the core and the sheath were both changed to S229R. The conjugated continuous fibers did not develop crimps. The measurement results for the conjugated continuous fibers and nonwoven fabrics are set forth in Table 2.

Reference Example 1

Crimped conjugated continuous fibers and nonwoven fabrics were obtained in the same manner as in Example 1, except that the propylene polymer (A) was changed to 5119 (Nishioki), the propylene polymer (B) was changed to S229R, and the embossing temperature was changed to 125° C. The measurement results for the crimped conjugated continuous fibers and nonwoven fabrics are set forth in Table 2.

Comparative Example 3

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 4

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 80:20.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 5

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 6

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 80:20.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 7

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 20:80.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 8

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 9

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 20:80.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 10

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 11

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 20:80.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 12

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 50:50.

In the spunbonding method, single-screw extruders were used and the propylene polymer (A) and the propylene polymer (B) were molten at 200° C.

The crimp properties and spinnability for the crimped conjugated continuous fibers are set forth in Table 2.

Comparative Example 13

A propylene polymer (A) and a propylene polymer (B) as indicated in Table 2 were melt-spun by a spunbonding method to form crimped conjugated continuous fibers in which the mass ratio of a core h3 and a sheath h4 in the continuous fiber was 80:20.

In the spunbonding method, single-screw extruders were used and the propylene polymer (A) and the propylene polymer (B) were molten at 200° C.

The crimp properties and spinnability for the crimped conjugated continuous fibers are set forth in Table 2.

TABLE 2

| | | | Comp. Ex. 1 | Comp. Ex. 2 | Ref. Ex. 1 | Comp. Ex. 3 |
|---|---|---|---|---|---|---|
| Core | Polymer | | S119 Nishioki | S229R | S119 Nishioki | Exxon 3155 |
| | MFR | g/10 min | 63 | 63 | 63 | 35 |
| | Mw | — | 204,000 | 204,000 | 204,000 | 204,000 |
| | Mn | — | 62,200 | 74,600 | 62,200 | 74,600 |
| | Mw/Mn | — | 3.28 | 2.73 | 3.28 | 4.69 |
| | Mz | — | 457,000 | 446,000 | 457,000 | 446,000 |
| | Mz/Mw | — | 2.24 | 2.19 | 2.24 | 2.47 |
| | Tm | ° C. | 158 | 143 | 158 | 160 |
| Sheath | Polymer | | S119 Nishioki | S229R | S229R | Exxon 3854 |
| | MFR | g/10 min | 63 | 63 | 63 | 25 |
| | Mw | — | 204,000 | 204,000 | 204,000 | 204,000 |
| | Mn | — | 62,200 | 74,600 | 74,600 | 62,200 |
| | Mw/Mn | — | 3.28 | 2.73 | 2.73 | 2.28 |
| | Mz | — | 457,000 | 446,000 | 446,000 | 457,000 |
| | Mz/Mw | — | 2.24 | 2.19 | 2.19 | 1.83 |
| | Tm | ° C. | 158 | 143 | 143 | 150 |
| | Core:sheath ratio | | 20:80 | 20:80 | 20:80 | 50:50 |
| | \|ΔMz/Mw\| | — | 0.00 | 0.00 | 0.05 | 0.64 |
| | \|ΔMw/Mn\| | — | 0.00 | 0.00 | 0.55 | 2.41 |
| | MFR ratio | — | 1.00 | 1.00 | 1.00 | 1.40 |
| | \|ΔTm\| | ° C. | 0 | 0 | 15 | 10 |
| | Melting temperature | ° C. | 200 | 200 | 200 | 200 |
| Embossing conditions | Embossed area percentage | % | 18 | 18 | 18 | — |
| | Linear pressure | N/mm | 60 | 60 | 60 | — |
| | Emboss roll temperature | ° C. | 133 | 120 | 125 | — |
| | Crown roll temperature | ° C. | 133 | 120 | 125 | — |
| Properties | Basis weight | $g/m^2$ | 24.5 | 24.5 | 24.8 | — |
| | Thickness | μm | 310 | 252 | 282 | — |
| | Porosity | % | 91.3 | 89.3 | 90.3 | — |
| | 2% tensile elongation strength (MD) | N/cm | 112 | 64 | 66 | — |
| | Softness in MD (distance) | mm | 72 | 54 | 52 | — |

TABLE 2-continued

| | | | | | | | |
|---|---|---|---|---|---|---|---|
| Crimp properties | | | CC | CC | AA | AA | |
| Number of crimps | | crimps/25 mm | 0.0 | 0.0 | 17.1 | 10.0 | |
| Spinnability | | | Sufficient | Sufficient | Sufficient | Insufficient | |
| | | | Comp. Ex. 4 | Comp. Ex. 5 | Comp. Ex. 6 | Comp. Ex. 7 | Comp. Ex. 8 |
| Core | Polymer | | S12A/ Y200GP = 88/12 | S12A/ Y200GP = 88/12 | S12A/ Y200GP = 88/12 | S119/HS135 = 92/8 | S119/HS135 = 92/8 |
| | MFR | g/10 min | 63 | 63 | 63 | 54 | 54 |
| | Mw | — | 252,000 | 252,000 | 252,000 | 219,000 | 219,000 |
| | Mn | — | 66,900 | 66,900 | 66,900 | 72,400 | 72,400 |
| | Mw/Mn | — | 3.77 | 3.77 | 3.77 | 3.02 | 3.02 |
| | Mz | — | 1,160,000 | 1,160,000 | 1,160,000 | 549,400 | 549,400 |
| | Mz/Mw | — | 4.60 | 4.60 | 4.60 | 2.51 | 2.51 |
| | Tm | ° C. | 158 | 158 | 158 | 158 | 158 |
| Sheath | Polymer | | S119 Nishioki | S119 Nishioki | S119 Nishioki | S119 Nishioki | S119 Nishioki |
| | MFR | g/10 min | 63 | 63 | 63 | 63 | 63 |
| | Mw | — | 204,000 | 204,000 | 204,000 | 204,000 | 204,000 |
| | Mn | — | 62,200 | 62,200 | 62,200 | 62,200 | 62,200 |
| | Mw/Mn | — | 3.28 | 3.28 | 3.28 | 3.28 | 3.28 |
| | Mz | — | 457,000 | 457,000 | 457,000 | 457,000 | 457,000 |
| | Mz/Mw | — | 2.24 | 2.24 | 2.24 | 2.24 | 2.24 |
| | Tm | ° C. | 158 | 158 | 158 | 158 | 158 |
| | Core:sheath ratio | | 80:20 | 50:50 | 80:20 | 20:80 | 50:50 |
| | \|ΔMz/Mw\| | — | 2.36 | 2.36 | 2.36 | 0.27 | 0.27 |
| | \|ΔMw/Mn\| | — | 0.49 | 0.49 | 0.49 | 0.25 | 0.25 |
| | MFR ratio | — | 1.00 | 1.00 | 1.00 | 0.86 | 0.86 |
| | \|ΔTm\| | ° C. | 0 | 0 | 0 | 0 | 0 |
| | Melting temperature | ° C. | 200 | 200 | 200 | 200 | 200 |
| Embossing conditions | Embossed area percentage | % | — | — | — | — | — |
| | Linear pressure | N/mm | — | — | — | — | — |
| | Emboss roll temperature | ° C. | — | — | — | — | — |
| | Crown roll temperature | ° C. | — | — | — | — | — |
| Properties | Basis weight | $g/m^2$ | — | — | — | — | — |
| | Thickness | μm | — | — | — | — | — |
| | Porosity | % | — | — | — | — | — |
| | 2% tensile elongation strength (MD) | N/cm | — | — | — | — | — |
| | Softness in MD (distance) | mm | — | — | — | — | — |
| Crimp properties | | | CC | CC | CC | CC | CC |
| Number of crimps | | crimps/25 mm | 0.0 | 0.0 | 0.0 | 4.0 | 3.0 |
| Spinnability | | | Sufficient | Sufficient | Sufficient | Sufficient | Sufficient |
| | | | Comp. Ex. 9 | Comp. Ex. 10 | Comp. Ex. 11 | Comp. Ex. 12 | Comp. Ex. 13 |
| Core | Polymer | | S229R/low MFR = 88/12 | S229R/low MFR = 88/12 | S119 Nishioki/ HS135 = 96/4 | S119 Nishioki/ HS135 = 96/4 | SA06A |
| | MFR | g/10 min | 44 | 44 | 58 | 58 | 59 |
| | Mw | — | 235,000 | 235,00C | 208,000 | 208,000 | 207,000 |
| | Mn | — | 77,300 | 77,300 | 63,000 | 63,000 | 68,700 |
| | Mw/Mn | — | 3.04 | 3.04 | 3.30 | 3.30 | 3.01 |
| | Mz | — | 751,600 | 751,600 | 517,000 | 517,000 | 524,000 |
| | Mz/Mw | — | 3.20 | 3.20 | 2.49 | 2.49 | 2.53 |
| | Tm | ° C. | 143 | 143 | 158 | 158 | 161 |
| Sheath | Polymer | | S229R | S229R | S119 Nishioki | S119 Nishioki | S119NP |
| | MFR | g/10 min | 63 | 63 | 63 | 63 | 63 |
| | Mw | — | 204,000 | 204,000 | 204,000 | 204,000 | 189,000 |
| | Mn | — | 74,600 | 74,600 | 62,200 | 62,200 | 74,800 |
| | Mw/Mn | — | 2.73 | 2.73 | 3.28 | 3.28 | 2.53 |
| | Mz | — | 446,000 | 446,000 | 457,000 | 457,000 | 393,000 |
| | Mz/Mw | — | 2.19 | 2.19 | 2.24 | 2.24 | 2.08 |
| | Tm | ° C. | 143 | 143 | 158 | 158 | 158 |
| | Core:sheath ratio | | 20:80 | 50:50 | 20:80 | 50:50 | 80:20 |
| | \|ΔMz/Mw\| | — | 1.01 | 1.01 | 0.25 | 0.25 | 0.45 |
| | \|ΔMw/Mn\| | — | 0.31 | 0.31 | 0.02 | 0.02 | 0.49 |
| | MFR ratio | — | 0.69 | 0.69 | 0.92 | 0.92 | 0.94 |
| | \|ΔTm\| | ° C. | 0 | 0 | 0 | 0 | 3 |
| | Melting temperature | ° C. | 200 | 200 | 200 | 200 | 200 |
| Embossing conditions | Embossed area percentage | % | — | — | — | — | — |
| | Linear pressure | N/mm | — | — | — | — | — |
| | Emboss roll temperature | ° C. | — | — | — | — | — |
| | Crown roll temperature | ° C. | — | — | — | — | — |
| Properties | Basis weight | $g/m^2$ | — | — | — | — | — |
| | Thickness | μm | — | — | — | — | — |
| | Porosity | % | — | — | — | — | — |
| | 2% tensile elongation strength (MD) | N/cm | — | — | — | — | — |
| | Softness in MD (distance) | mm | — | — | — | — | — |

TABLE 2-continued

| | | | | | | |
|---|---|---|---|---|---|---|
| Crimp properties | | AA | AA | CC | CC | CC |
| Number of crimps | crimps/25 mm | 40.0 | 20.0 | 4.0 | 4.0 | 4.0 |
| Spinnability | | Insufficient | Insufficient | Sufficient | Sufficient | Sufficient |

INDUSTRIAL APPLICABILITY

The nonwoven fabrics according to the present invention have excellent properties such as spinnability, strength, softness and water resistance and are useful in side gathers, back sheets, top sheets and waist parts of diapers or sanitary napkins.

The invention claimed is:

1. A crimped conjugated fiber having a cross-sectional configuration wherein:

a cross section of the fiber comprises at least a portion (a) and a portion (b), the mass ratio of the portion (a) and the portion (b) [(a):(b)] is in the range of 10:90 to 55:45, the portion (a) comprises a propylene polymer (A) and the portion (b) comprises a propylene polymer (B), the propylene polymer (A) has Mz/Mw (A) and the propylene polymer (B) has Mz/Mw (B) wherein the difference thereof [Mz/Mw (A)−Mz/Mw (B): ΔMz/Mw] is in the range of 0.30 to 2.2, the propylene polymer (A) has a melting point [Tm (A)] and the propylene polymer (B) has a melting point [Tm (B)] wherein the absolute value of the difference of the melting points is in the range of 0 to 5° C., and the ratio of MFR (A) of the propylene polymer (A) to MFR (B) of the propylene polymer (B) is in the range of 0.8 to 1.2.

2. The crimped conjugated fiber according to claim 1, wherein the propylene polymer (A) has Mw/Mn (A) and the propylene polymer (B) has Mw/Mn (B) wherein the absolute value of the difference thereof [|Mw/Mn (A)−Mw/Mn (B)|: |ΔMw/Mn|] is not more than 1.5.

3. The crimped conjugated fiber according to claim 1, wherein the crimped conjugated fiber has an eccentric core-sheath configuration in which the portion (a) is a core (a') and the portion (b) is a sheath (b').

4. The crimped conjugated fiber according to claim 3, wherein the mass ratio of the core (a') and the sheath (b') [(a'):(b')] is in the range of 10-30:90-70.

5. The crimped conjugated fiber according to claim 1, wherein the propylene polymer (A) and the propylene polymer (B) are both propylene homopolymers.

6. The crimped conjugated fiber according to claim 1, wherein the propylene polymer (A) and the propylene polymer (B) are both propylene/α-olefin random copolymers.

7. A nonwoven fabric comprising the crimped conjugated fiber described in claim 1.

8. The nonwoven fabric according to claim 7, wherein the crimped conjugated fiber is thermally fusion bonded by embossing.

9. The crimped conjugated fiber according to claim 2, wherein the propylene polymer (A) and the propylene polymer (B) are both propylene homopolymers.

10. The crimped conjugated fiber according to claim 2, wherein the propylene polymer (A) and the propylene polymer (B) are both propylene/α-olefin random copolymers.

11. A nonwoven fabric comprising the crimped conjugated fiber described in claim 2.

12. A nonwoven fabric comprising the crimped conjugated fiber described in claim 3.

13. A nonwoven fabric comprising the crimped conjugated fiber described in claim 4.

14. The nonwoven fabric according to claim 11, wherein the crimped conjugated fiber is thermally fusion bonded by embossing.

15. The nonwoven fabric according to claim 12, wherein the crimped conjugated fiber is thermally fusion bonded by embossing.

16. The nonwoven fabric according to claim 13, wherein the crimped conjugated fiber is thermally fusion bonded by embossing.

* * * * *